US007846324B2

(12) United States Patent
Annamalai et al.

(10) Patent No.: US 7,846,324 B2
(45) Date of Patent: Dec. 7, 2010

(54) USE OF HEAT EXCHANGER IN A PROCESS TO DEASPHALT TAR

(75) Inventors: Subramanian Annamalai, Houston, TX (US); Paul F. Keusenkothen, Houston, TX (US); Alok Srivastava, Singapore (CN); James N. McCoy, Houston, TX (US)

(73) Assignee: Exxonmobil Chemical Patents Inc., Houston, TX (US)

( * ) Notice: Subject to any disclaimer, the term of this patent is extended or adjusted under 35 U.S.C. 154(b) by 352 days.

(21) Appl. No.: 12/023,322

(22) Filed: Jan. 31, 2008

(65) Prior Publication Data

US 2008/0210598 A1 Sep. 4, 2008

Related U.S. Application Data

(60) Provisional application No. 60/904,592, filed on Mar. 2, 2007.

(51) Int. Cl.
*C10C 3/00* (2006.01)

(52) U.S. Cl. ..... 208/86; 208/309; 208/130; 208/131

(58) Field of Classification Search ..... 208/86
See application file for complete search history.

(56) References Cited

U.S. PATENT DOCUMENTS

| | | | | |
|---|---|---|---|---|
| 2,633,449 | A | 3/1953 | Cheney | |
| 3,240,695 | A * | 3/1966 | Denbo | 208/130 |
| 3,413,211 | A | 11/1968 | Becraft et al. | |
| 3,622,502 | A | 11/1971 | Mason et al. | |
| 3,691,058 | A | 9/1972 | Hamner et al. | |
| 3,707,459 | A | 12/1972 | Mason et al. | |
| 3,956,101 | A | 5/1976 | Hara et al. | |
| 4,207,168 | A | 6/1980 | Simone | |
| 4,219,404 | A | 8/1980 | Dickakian | |
| 4,264,334 | A | 4/1981 | Durand et al. | |
| 4,414,095 | A | 11/1983 | Dickakian | |
| 4,431,512 | A | 2/1984 | Dickakian | |
| 4,446,002 | A | 5/1984 | Siegmund | |
| 5,215,649 | A | 6/1993 | Grenoble et al. | |
| 5,443,715 | A | 8/1995 | Grenoble et al. | |
| 5,489,374 | A | 2/1996 | Romine et al. | |
| 6,632,351 | B1 * | 10/2003 | Ngan et al. | 208/130 |
| 2007/0007170 | A1 * | 1/2007 | Strack et al. | 208/106 |

FOREIGN PATENT DOCUMENTS

| | | |
|---|---|---|
| BE | 889974 | 1/1981 |
| CA | 1069846 | 1/1980 |
| DE | 32 27 490 | 1/1984 |
| DE | 4308507 | 9/1993 |
| EP | 0 100 198 | 2/1984 |
| EP | 0 021 708 | 6/1984 |
| EP | 0 056 338 | 8/1985 |
| EP | 0 086 607 | 5/1987 |
| EP | 0 243 509 | 8/1990 |
| EP | 0 791 040 | 8/1997 |

(Continued)

*Primary Examiner*—Glenn A Caldarola
*Assistant Examiner*—Michelle L Stein

(57) ABSTRACT

The invention relates to a process for upgrading tar using a heat exchanger in series with a vapor/liquid separator to separate tar into a heavy tar asphaltenic material and a deasphalted tar material.

8 Claims, 1 Drawing Sheet

FOREIGN PATENT DOCUMENTS

| | | |
|---|---|---|
| FR | 2510133 | 1/1983 |
| GB | 2 014 605 | 8/1979 |
| GB | 1 601 644 | 11/1981 |
| JP | 52-081321 | 7/1977 |
| JP | 58-149991 | 9/1983 |
| JP | 61-098794 | 5/1986 |
| WO | WO 91/13951 | 9/1991 |
| WO | WO 91/17230 | 11/1991 |

* cited by examiner

USE OF HEAT EXCHANGER IN A PROCESS TO DEASPHALT TAR

PRIORITY CLAIM

This non-provisional application claims priority to and the benefit of U.S. Provisional Application Ser. No. 60/904,592, filed Mar. 2, 2007.

FIELD OF THE INVENTION

The invention relates to deasphalting tar (pyrolysis fuel oil).

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace wherein the feedstock, typically comprising crude or a fraction thereof optionally desalted, is heated sufficiently to cause thermal decomposition of the larger molecules. Among the valuable and desirable products include light olefins such as ethylene, propylene, and butylenes. The pyrolysis process, however, also produces molecules that tend to combine to form high molecular weight materials known as steam cracked tar or steam cracker tar, hereinafter referred to as "SCT". These are among the least valuable products obtained from the effluent of a pyrolysis furnace. In general, feedstocks containing higher boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

In U.S. Pat. No. 4,446,002, the precipitation of sediment in unconverted residuum obtained from a virgin residuum conversion process is taught to be suppressed by blending the unconverted residuum with an effective amount of a virgin residuum having an asphaltene content of at least about 8 wt % of the virgin residuum at a temperature sufficient to maintain both residuum components at a viscosity of no greater than about 100 cSt (centistokes) during blending. Virgin residuum is the bottoms product of the atmospheric distillation of petroleum crude oil at temperatures of about 357° C. to 385° C.

In U.S. Pat. No. 5,443,715, steam cracked tar is upgraded by mixing with a "hydrogen donor", preferably hydrotreated steam cracked tar, at or downstream of quenching of the effluent of a gas oil steam cracker furnace. In this regard, see also U.S. Pat. Nos. 5,215,649; and 3,707,459; and WO 91/17230.

Other references of interest include U.S. Pat. Nos. 3,622,502; 3,691,058; 4,207,168; 4,264,334; WO 91/13951; DE 4308507; and JP 58-149991.

Despite these advances, there remains a problem that tar continues to be generated in amounts beyond the capacity of current technology to be efficiently utilized. Thus, significant amounts of tar must be disposed of by adding to fuel oil pools or simply combusted locally to generate, for example, steam. However, steam cracker tar, even relatively low asphaltene steam cracker tar, is generally incompatible with fuel oil pools such as Bunker C fuel oil. Onsite tar burning in site boilers is then preferred to avoid tar separation investment, but tighter emission regulations increasingly limit the amount that can be burned for this purpose.

Accordingly, it would be highly beneficial if a process could be found to upgrade tar to more useable products.

The present inventors have discovered that tar may be readily separated using a heat exchanger in series with a vapor/liquid separator downstream of a pyrolysis furnace to heat steam cracker tar and separate it into a deasphalted tar fraction and a heavy asphaltenic tar fraction.

SUMMARY OF THE INVENTION

According to an embodiment of the invention there is a process comprising: feeding a first stream comprising tar to the process side of a heat exchanger; heating said first stream whereby said first stream separates into a two phase stream including a vapor phase and liquid phase; then passing said two phase stream to a vapor liquid separator whereby said two phase stream is separated into a vapor stream comprising deasphalted tar and a liquid stream comprising asphaltenic heavy tar.

In another embodiment, the invention is directed to a process for deasphalting tar comprising the integration of a high temperature heat exchanger and a vapor liquid separator drum. Liquid tar feeds the process side of the heat exchanger and exits the exchanger as a two-phase stream. The two-phase stream is separated in the vapor liquid separator drum into a deasphalted tar stream and an asphaltenic heavy tar product. The heated fluid on the other side of the high temperature exchanger is preferably superheated high pressure TLE steam.

These and other objects, features, and advantages will become apparent as reference is made to the following detailed description, drawing, preferred embodiments, examples, and appended claims.

DETAILED DESCRIPTION

Figure 1:
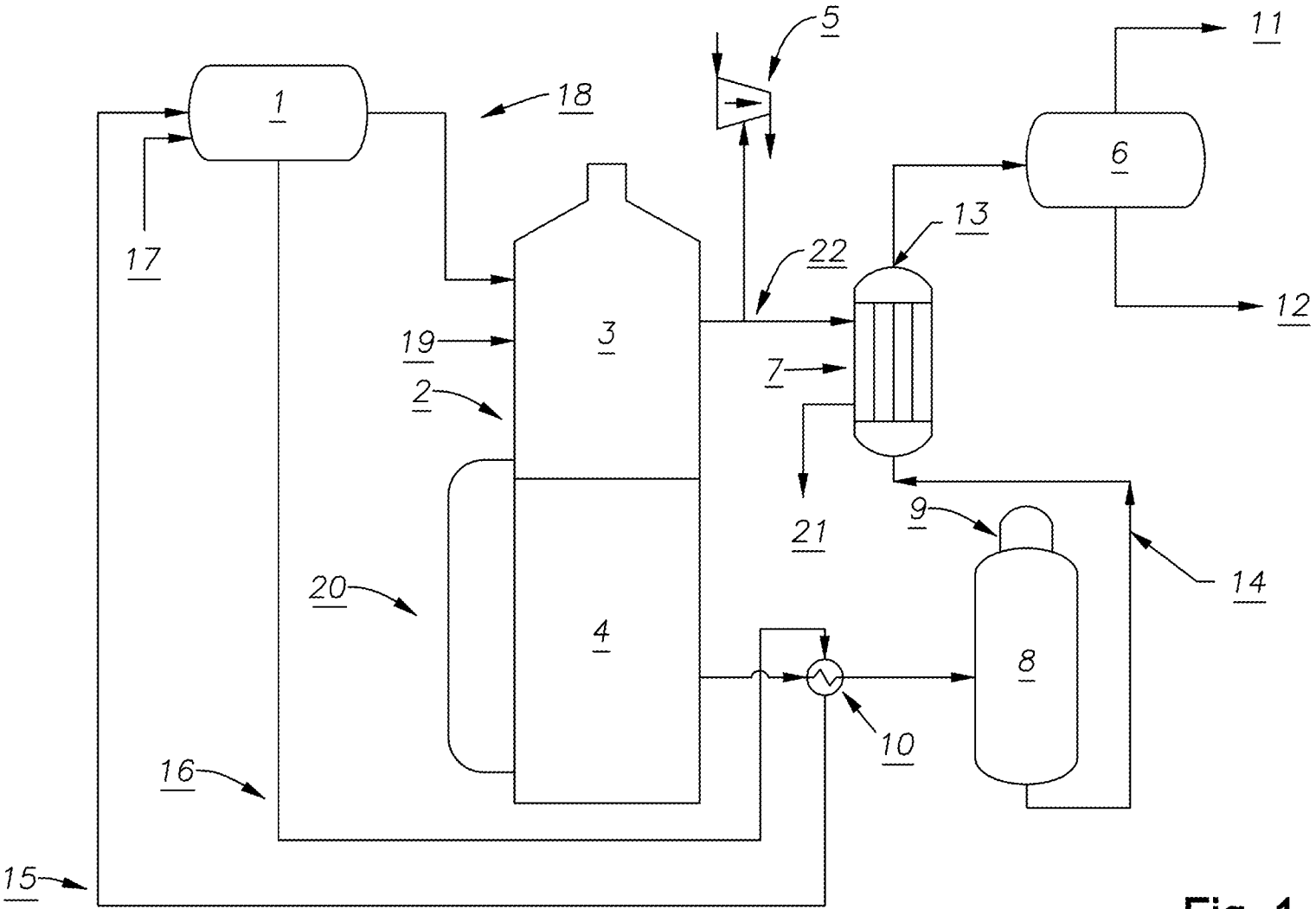
FIG. 1 is a simplified flow plan illustrating a preferred embodiment of the invention.

According to an embodiment of the invention there is a process comprising: feeding a first stream comprising tar to the process side of a heat exchanger; heating said first stream whereby said first stream separates into a two phase stream including a vapor phase and liquid phase; then passing said two phase stream to a vapor liquid separator whereby said two phase stream is separated into a vapor stream comprising deasphalted tar and a liquid stream comprising asphaltenic heavy tar.

The feed stream fed to the heat exchanger preferably comprises the bottoms product of a first fractionator downstream of a pyrolysis furnace.

The process side of the heat exchanger is preferably heated by the use of superheated steam on the non-process side of said heat exchanger. The heat for the non-process side is preferably from steam superheated in the convection section of a pyrolysis furnace, a pyrolysis furnace TLE, or a combination thereof.

In another embodiment, the invention concerns feeding tar to a pyrolysis furnace, said tar obtained as bottoms product of a fractionator, preferably the primary fractionator, downstream from a steam cracker furnace (wherein the pyrolysis furnace and the steam cracker may be the same or different), wherein the pyrolysis furnace to which the tar feed is integrated with a heat exchanger downstream thereof, whereby a heat exchange fluid for the non-process side of said heat exchanger is heated in the convection section of said pyrolysis furnace. The heat exchanger is used to heat a stream comprising tar on the process side of said heat exchanger.

The invention is also related to a system comprising a pyrolysis furnace, a primary fractionation tower downstream of said pyrolysis furnace, and a heat exchanger downstream of said primary fractionation tower having a heat exchange fluid circulating between the convection section of said pyrolysis furnace and said heat exchanger. In preferred embodiment, the process side of said heat exchanger is fluidly connected upstream with the bottoms of said primary fractionation tower and downstream with a vapor liquid separator.

The invention is also directed to a process for deasphalting tar comprising the integration of a high temperature heat exchanger and a vapor liquid separator drum. Liquid tar feeds the process side of the heat exchanger and exits the exchanger as a two-phase stream; the two-phase stream is separated in the vapor liquid separator drum into a deasphalted tar stream and an asphaltenic heavy tar product. The heated fluid on the other side of the high temperature exchanger is preferably superheated high pressure TLE steam.

In preferred embodiments, the deasphalted tar cut taken as vapor from the liquid vapor separator is compatible with refinery fuel oil pools.

In another preferred embodiment, the asphaltenic heavy tar product taken as the liquid from the liquid vapor separator is sent to POX and/or coker units.

Crude, as used herein, means whole crude oil as it issues from a wellhead, optionally including a step of desalting and/or other steps as may be necessary to render it acceptable for conventional distillation in a refinery. Crude as used herein is presumed to contain resid unless otherwise specified. The feedstream to the pyrolysis furnace will comprise crude or a fraction thereof.

The terms thermal pyrolysis unit, pyrolysis unit, steam cracker and steamcracker are used synonymously herein; all refer to what is conventionally known as a steam cracker, even though steam is optional. Typically in the description herein, when "pyrolysis furnace" and "steam cracker" are used in the same description (such as in the appended claims), this allows for there to be one furnace or multiple pyrolysis furnaces to be integrated into a system.

The term vacuum pipestill (or vacuum pipe still), vacuum tower, and "VPS" are also used synonymously herein, and include apparatus per se well known in refining operations.

The term "POX" means a partial oxidation and POX unit as used herein refers to the apparatus within which the partial oxidation occurs. The term "coking" or "delayed coking" refers to a thermal cracking process by which a heavy material is converted into lighter material and coke and the coking unit refers to the apparatus within which the coking occurs. Both process and apparatus terms are well known per se in refining.

In a preferred embodiment of the present invention, optional partial oxidation reacts at least a portion of the hydrocarbon feed from the vapor liquid separator with oxygen at high temperatures to produce a mixture of hydrogen and carbon monoxide (Syn Gas). While the conditions of partial oxidation are not critical and can be determined by one of ordinary skill in the art, for the present invention preferred conditions include a temperature of about 1455° C. (±50° C.) and pressure of about 870 psig (±25 psig), measured at the reactor inlet. The $H_2$ and CO yields will vary according to conditions but in preferred embodiments will be in the range of about 0.98 to 1.8 $H_2$/CO (molar ratio), which may be achieved without undue experimentation by one of ordinary skill in the art in possession of the present disclosure. The Syn Gas is preferably used to make alcohols in integration with the well-known Oxo Process, or to make fuel, or to make a hydrogen rich product, or a combination of these uses.

In another embodiment of the present invention, optional coking in the coker unit converts at least a portion of the hydrocarbon feed from the vapor liquid separator to coker naphtha and coker gas oil as overheads/sidestreams and coke as a bottoms product. In the present invention, the apparatus used may be a typical coker used in refinery processing, which in refining process converts residual oil from the crude unit vacuum or atmospheric column into gas oil. The process of coking or delayed coking is a semi-continuous thermal cracking process which can be broken down to three distinct stages. The feed undergoes partial vaporization and mild cracking as it passes through the coking furnace. The vapours undergo cracking as they pass through the coke drum to fractionation facilities downstream. In a refinery the typical products of gas, naphtha, jet fuel and gas oil are separated in the fractionation facilities. According to the present invention, the products comprise coker naphtha and coker gas oil separated in the fractionation facilities; the petroleum coke remains in the drum. The heavy hydrocarbon liquid trapped in the coke drum is subjected to successive cracking and polymerization until it is converted to vapours and coke.

While appropriate coker conditions may be determined without undue experimentation by one of ordinary skill in the art in possession of the present disclosure, preferred conditions include a temperature of about 450° C. to 550° C. and pressure of about 15-25 psig, measured at the reactor inlet. Coke resulting from a low sulfur feed may be used for needle coke or anode coke. More generally, the coke produced by the process of the invention may be used for fuel.

"Tar" or steam cracker tar (SCT) as used herein is also referred to in the art as "pyrolysis fuel oil". The terms will be used interchangeably herein. The tar will typically be obtained from the first fractionator downstream from a steam cracker (pyrolysis furnace) as the bottoms product of the fractionator, nominally having a boiling point of 550° F.+ (288° C.+) and higher. As noted elsewhere herein, the pyrolysis furnace that produces the tar feed to the process side of the heat exchanger according to the present invention may be the same pyrolysis furnace that superheats the steam for the non-process side of said heat exchanger, or it may be different. Likewise, in the case where the pyrolysis furnace that produces said tar is a TLE quench furnace, the TLE quench furnace may provide the superheated steam for the non-process side. In other words, the system according to the present invention may be integrated to a greater or less extent, depending on engineering choices—this is one of the advantages of the present invention. Numerous possibilities will immediately be apparent to one of ordinary skill in the art in possession of the present disclosure.

In a preferred embodiment, tar is obtained as a product of a pyrolysis furnace wherein additional products include a vapor phase including ethylene, propylene, butenes, and a liquid phase comprising $C_{5+}$ species, having a liquid product distilled in a primary fractionation step to yield an overheads comprising steam-cracked naphtha fraction (e.g., $C_5$-$C_{10}$ species) and steam cracked gas oil (SCGO) fraction (i.e., a boiling range of about 400° F. to 550° F. e.g., $C_{10}$-$C_{15}$/$C_{17}$ species), and a bottoms fraction comprising SCT and having a boiling range above about 550° F. (e.g., $C_{15}$/$C_{17}$+ species).

The term "asphaltene" as used herein means a material obtainable from crude oil and having an initial boiling point above 1200° F. (650° C.) and which is insoluble in a paraffinic solvent.

The feed to the pyrolysis furnace may comprise crude (such as a high sulfur containing virgin crude rich in polycyclic aromatics which has been desalted), or a crude fraction thereof (such as may be obtained from an atmospheric pipestill (APS) or vacuum pipestill (VPS) of a type per se well-known in the art, or typically a combination of APS followed by VPS treatment of the APS bottoms). Additional advantaged feeds are discussed elsewhere herein. The crude and/or fraction thereof are optionally but preferably desalted prior to being provided to the pyrolysis furnace. In general the operating conditions of such a furnace, which may be a typical pyrolysis furnace such as known per se in the art, can be determined by one of ordinary skill in the art in possession of the present disclosure without more than routine experimentation. Typical conditions will include a radiant outlet temperature of between 760° C.-880° C., a cracking residence time period of 0.01 to 1 sec, and a steam dilution of 0.2 to 4.0 kg steam per kg hydrocarbon.

Optionally, the pyrolysis furnace may have a vapor/liquid separation device (sometimes referred to as flash pot or flash drum) integrated therewith, such as disclosed and described in U.S. patent applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. Another preferred vapor/liquid separation device is described in U.S. Pat. No. 6,632,351.

In a preferred embodiment using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments a feedstream comprising crude or a fraction thereof, optionally desalted and/or demetallated, and preferably comprising resid, is provided to the inlet of a convection section of a pyrolysis unit, wherein it is heated so that at least a portion of the feedstream is in the vapor phase. Steam is optionally but preferably added in this section and mixed with the feedstream. The heated feedstream with optional steam and comprising a vapor phase and a liquid phase is optionally flashed in a vapor/liquid separation device, as previously mentioned, to drop out at least a portion of the heaviest fraction (e.g., asphaltenes). In embodiments the vapor/liquid separation device integrated with the pyrolysis furnace operates at a temperature of from about 800° F. (about 425° C.) to about 850° F. (about 455° C.). The feedstream comprising a vapor phase and a liquid phase (or in the case of use of the optional vapor/liquid separation device, the overheads from the vapor/liquid separation device) are then introduced via crossover piping into the radiant section where the overheads are quickly heated, such as at pressures ranging from about 10 to 30 psig, to a severe hydrocarbon cracking temperature, such as in the range of from about 1450° F. to 1550° F., to provide cracking of the feedstream.

The feed comprising crude or fraction thereof is converted in the pyrolysis furnace, optionally having a vapor/liquid separator as described above, at an elevated temperature to cracked products. The hot cracked gas may be quenched or passed at substantially the elevated temperature of the furnace into a pyrolysis fractionating column, also referred to as the first or primary fractionator or fractionating column.

Pyrolysis furnaces typically employ either transfer line exchangers ("TLE furnace" or simply "TLE") to quench the furnace effluent or quench-oil direct quench system ("Quench-oil furnace"). In the case where TLE is employed, it is convenient to integrate the present invention so that the heat exchange fluid from the TLE quench unit is used to heat or superheat the tar in the heat exchanger (as described more fully below).

Within the fractionating column, the cracked products are separated into a plurality of fractionation streams including $H_2$, methane, higher alkanes, and olefins such as ethylene, propylene, butenes, which are recovered from the fractionating column as overheads or sidestreams, along with a bottoms product comprising tar and steam cracked gas oil (SCGO). Typically this residue material will have a boiling point above about 400° F. (It should be noted that boiling points given herein are to be taken at atmospheric conditions unless another pressure condition is indicated) The tar may be separated from the other materials as bottoms product in a vacuum pipestill according to the present invention and sent to a heat exchanger, where it is heated by steam heated in the convection section of the pyrolysis furnace and/or TLE quench, with the heated stream, now comprising a vapor phase and a liquid phase, separated in a vapor/liquid separator such as previously described in the aforementioned U.S. patent applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; 2005/0261538; and U.S. Pat. No. 6,632,351.

The invention will now be illustrated by reference to FIG. 1, which is a simplified flow plan according to a preferred embodiment of the invention wherein the vapor liquid separation device is integrated with a pyrolysis furnace. It will be understood by those of skill in the art that this embodiment is intended only as one illustration and is not intended to be limiting. Numerous variations will be immediately apparent to the skill artisan in possession of the present disclosure.

FIG. 1 shows a system according to one embodiment of the invention, including a steam drum 1 supplying high pressure steam and fluidly connect through line 18 to a pyrolysis furnace 2, including convection section 3 and radiant section 4.

High pressure steam which has been superheated such as to a temperature of >950° F. in the furnace convection section 3 exits pyrolysis furnace 2 and is sent through line 22 to a heat exchanger 7 and optionally to a target requirement such as an HPS turbine illustrated here by conventional symbol 5. The high pressure, high temperature steam that is used to heat the tar, as discussed below, in heat exchanger 7 can be sent, cooled by heat exchange with the tar, via line 21 to target requirements such as the condensate header (not shown), recycled and/or reheated in the convection section 3 to increase its temperature for other target requirements such as in driving the PGC steam furnace, or returned to steam drum 1 through line 17.

In an embodiment heat exchanger 7 is a conventional tubular reactor, which may be described as a single-pass heat exchanger (e.g., shell-and-tube). In an embodiment, the tube side is the process side and the fluid in the tubes (line 9 preferably divides into plural tubes arranged in parallel in heat exchanger 7 prior to merging of the heated liquid before exiting the heat exchanger 7 at point 13) is heated in the heat exchanger 7 before passing through to vapor liquid separator 6, and the shell side contains the circulating heat exchange fluid (which is preferably water/steam but could also be some other process fluid such as a hydrocarbon mixture) which enters through line 22, after being heated and preferably superheated in convection section 3, where it heats the "process fluid" (tar) and then exits through line 21. Numerous other types of heat exchangers are known per se in the art.

Steam drum 1 may be a conventional steam drum or a steam drum such as described in U.S. Patent Application Publication 2006/0270882 (thus, by way of example, it may be a steam drum such as illustrated in any of FIGS. 1-4 of the aforementioned publication). Water/steam enters steam drum 1 via conduit 15 into (or near) the top of a conventional steam drum 1. The water in conduit 15 either drops into the steam drum 1 or is entrained in steam and removed along with steam via conduit 18 to be further heated or superheated in convection section 3 of pyrolysis furnace 2, described in more detail below. The steam and entrained water that exits the steam drum 1 via conduit 18 is replaced by make-up water or boiler feed water (BFW) which is fed into the steam drum 1 via conduit 17. Water exiting steam drum 1 via conduit 16 is returned to stream drum 1 after heat exchange with exchanger 10 discussed more fully below. As would be recognized by one of ordinary skill in the art, passage through steam drum 1 is induced by at least one of (i) forced flow, such as by mechanically pumping said water/steam, preferably the water in conduit 4, and (ii) thermosyphon circulation.

The process side of the pyrolysis furnace, including upgrading of the tar fraction, will now be described.

Feed 19 comprising tar enters the pyrolysis furnace 2 and is heated in the convection section 3 before entering the radiant section 4. Line 20 represents an optional embodiment wherein the feedstream is passed through a vapor/liquid separator integrated with pyrolysis furnace 2, such as described in U.S. patent application Publication Nos. 2004/0004022, 20040004027, and 2004/0004028.

The products exit the radiant section 4 of pyrolysis furnace 2 through the line passing from the radiant section 4 through heat exchanger 10 and then to the primary fractionator 8.

Primary fractionator 8 may be a simple fractionation column known in the art wherein tar exits at the bottom through line 14 and one or more other products enter at one or more exit points above the bottoms portion (which are not shown for convenience of view). Optionally, primary fractionator 8 may comprise a boot (not shown) which may be used to decrease liquid residence time in the flash zone of the primary fractionator (above the bottoms portion but below the distillation trays) so as to minimize asphaltene polymerization, and optional rectification zone 9 which may provide additional fractionation with or without additional distillation trays. Optionally, a side flash drum outlet or a vortex breaker (not shown) can be added to prevent a vortex forming in the outlet, as described in more detail in the aforementioned U.S. Pat. No. 4,140,212 or U.S. Appl. Publication Nos. 20040004028, 20050261530, 20060089519; or WO 2004005431 or WO2005113715, and likewise baffles (not shown in the present drawing but shown in detail in the aforementioned references) may also be installed inside the flash drum to further avoid and reduce any portion of the separated liquid phase, flowing downwards in the flash drum, from being entrained in the up flow vapor phase in the flash drum.

The bottoms product comprising the tar and other materials boiling above about 550° F. exits through line 14 and is sent to the process side of heat exchanger 7 where it is heated to a temperature of about 850° F. at exit point 13 by heated steam from convection section 3 entering the non-process side of heat exchanger 7 via line 22, and passed to liquid/vapor separator 6. Optionally, diluents like steam or hydrogen may be mixed with primary fractionator 8 bottom tar at some predetermined point to reduce the partial pressure of the tar, thus lowering the vaporising temperature for the tar. Low pressure (LP) steam may be the preferred choice as it can be vented. In liquid vapor separator 6 it is separated into an overhead 11 which is the deasphalted tar product and bottoms product 12, which is the heavy asphaltenic tar product. Plural exchangers 7 are a preferred embodiment so that one or more exchangers can be taken out for mechanical cleaning while keeping the process continuous.

Accordingly, as discussed above by reference to a specific example, the present invention provides a method of upgrading tar.

In preferred embodiments, the deasphalted tar product obtained as overheads through line 11 is blended with heavy fuel oils and/or Bunker fuels (e.g., Bunker C fuel oil). Typical specifications are provided below for an RSFO blend meeting the 380 centistoke (cSt) requirements for Fuel Oil is given below. For a composition according to the present invention, the most important specifications (with regard to meeting the various specifications for published fuel oil requirements) are Kinematic Viscosity (KV), Specific Gravity (SG) and compatibility (e.g., one or both of the sediment criteria listed below). It is an important and surprising discovery of the present inventors that such specifications can be met for a mixture containing steam cracked tar.

One typical specification for a fuel oil is listed in Table 1.

TABLE 1

(RFSO) Standard Fuel Oil Specifications in Singapore (Platt's)

| Property | 380 cSt Fuel Oil |
|---|---|
| Sulfur Max | 4.0% |
| Kinematic Vis @50 deg C. Max [ASTM D445] | 380 cSt |
| SG @15C deg C. Max | 0.991 |
| Flash Point Min | 66° C. |
| Pour Point Max | 24° C. |
| Ash on a weight basis Max | 0.10% |
| Conradson Carbon Residue (CCR) Max | 18% |
| Vanadium Max | 200 ppm |
| Sodium Max | 100 ppm |
| Aluminum + Silicon Max | 80 ppm |
| Water by distillation volume Max | 0.50% |
| Sediment by extraction Max | 0.10% |
| Total existent sediment | 0.10% |

The heavy tar asphaltenic product obtained as bottoms through conduit 12 may be further upgraded by sending to a POX or refinery Coker unit, as previously described.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention.

What is claimed is:

1. A process comprising:

(a) feeding a first stream comprising tar to the process side of a heat exchanger;

(b) heating said first stream to create a two phase heated fluid comprising a vapor phase and liquid phase;

(c) passing said two phase heated fluid to a vapor liquid separator whereby said two phase heated fluid is separated into a vapor stream comprising deasphalted tar and a liquid stream comprising asphaltenic heavy tar.

2. The process according to claim 1, wherein said tar of said first stream is obtained as bottoms product of a primary fractionator downstream from a pyrolysis furnace integrated with said heat exchanger so that heat for heating said first stream is at least partially generated in the convection section of said pyrolysis furnace.

3. The process according to claim 1, wherein said tar of said first stream is obtained as bottoms product of a primary fractionator downstream from a pyrolysis furnace integrated with said heat exchanger, said pyrolysis furnace comprising a TLE quench, wherein heat for heating said first stream is at least partially generated in said TLE quench.

4. The process according to claim 1, wherein said heat for heating said first stream is superheated high pressure steam.

5. The process according to claim 1, wherein said deasphalted tar is blended with heavy fuel oils and/or Bunker fuels, preferably Bunker C fuel oil, more preferably a fuel oil meeting the specifications of an RSFO blend.

6. The process according to claim 1, wherein said asphaltenic heavy tar is upgraded by sending to a POX and/or Coker unit.

7. The process according to claim 1, wherein said heating in said step (b) is within said heat exchanger.

8. The process according to claim 1, wherein said heat exchanger is a single-pass heat exchanger.

* * * * *